United States Patent [19]

Bell

[11] 3,985,288

[45] Oct. 12, 1976

[54] COMPARTMENTED CARTON

[75] Inventor: Richard L. Bell, Glenmoore, Pa.

[73] Assignee: Container Corporation of America, Chicago, Ill.

[22] Filed: Jan. 30, 1976

[21] Appl. No.: 653,765

[52] U.S. Cl. ..... 229/38; 229/22

[51] Int. Cl.[2] ..... B65D 5/08

[58] Field of Search ..... 229/37 R, 38, 39 R, 229/22

[56] References Cited

UNITED STATES PATENTS

| | | | |
|---|---|---|---|
| 2,008,949 | 7/1935 | Ellsworth | 229/38 |
| 2,334,997 | 11/1943 | Doll | 229/22 X |
| 3,356,281 | 12/1967 | Buttery | 229/39 R |
| 3,397,771 | 8/1968 | Fogle | 229/22 X |
| 3,430,841 | 3/1969 | Kanaga | 229/53 |
| 3,532,310 | 10/1970 | Finfrock | 248/46 |
| 3,880,342 | 4/1975 | Longo, Jr. | 229/22 X |
| R223,670 | 6/1953 | Currivan | 229/38 |

FOREIGN PATENTS OR APPLICATIONS

| | | | |
|---|---|---|---|
| 947,699 | 1/1949 | France | 229/22 |

*Primary Examiner*—Davis T. Moorhead
*Attorney, Agent, or Firm*—Carpenter & Ostis

[57] ABSTRACT

A triangular, tubular carton formed of foldable paperboard and including an internal partition which divides the carton into two compartments of unequal shape and size.

2 Claims, 7 Drawing Figures

COMPARTMENTED CARTON

SUMMARY OF THE INVENTION

The present invention relates to collapsible compartmented folding cartons. While it is recognized that the prior art includes many types and styles of collapsible tubular cartons, the present invention is concerned with a specific style of triangular carton which is collapsible and which contains an integral portion which divides the carton into compartments of varying shapes and sizes for receipt of separate objects of varying sizes and shapes.

It is therefore, an object of the invention to provide a compartmented carton, formed of a unitary blank of foldable sheet material such as paperboard, which has an integral partition dividing the interior into two compartments of unequal size and shape.

A more specific object of the invention is to provide a tubular, triangular carton wherein one of the walls of the carton comprises a pair of coplanar panels having foldably connected thereto a pair of partition panels extending into the carton and secured to each other to form a partition which forms triangular and trapezoidal compartments of different sizes.

These and other objects of the invention will be apparent from an examination of the following description and drawings.

It will be understood that certain elements may have been intentionally omitted from certain views where they are believed to be illustrated to better advantage in other views.

Figure 2:
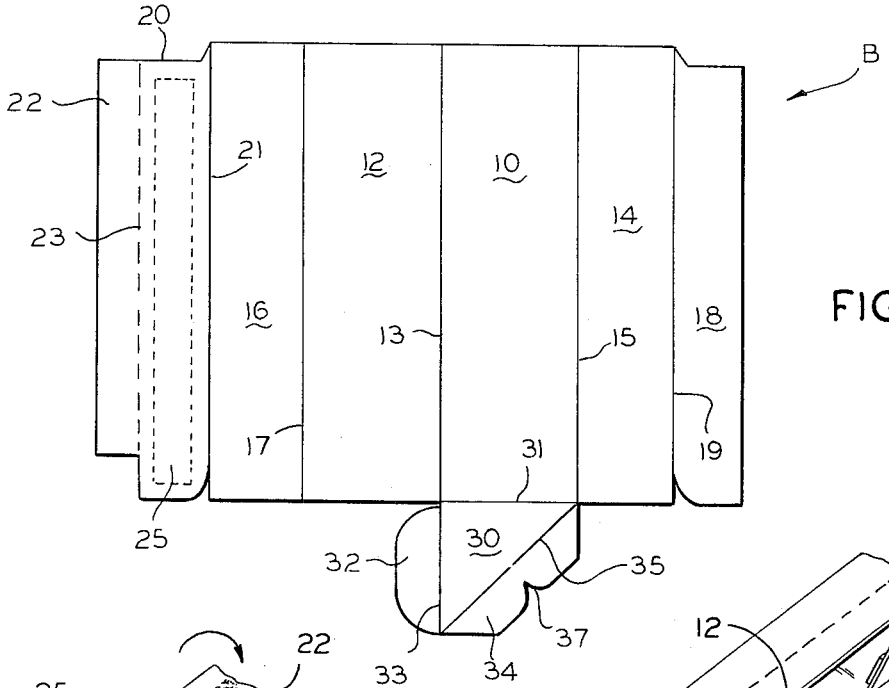
FIG. 2 is a plan view of the outside surface of the blank from which the carton of the other views may be formed.
Figure 1:
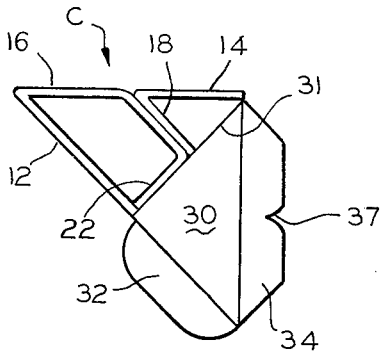
FIG. 1 is a top plan view of a carton embodying features of the present invention, with one end closure flap shown in the open position.

Referring now to the drawing, it will be seen that the carton embodying features of the invention and indicated generally at C in FIG. 1 is a collapsible, triangular, tubular, compartmented carton which may be formed from the unitary blank of sheet material such as paperboard indicated generally at B in FIG. 2.

The carton includes a pair of angularly disposed first and second front side walls 10 and 12 respectively, which are foldably joined along a fold line 13. The third or rear wall of the carton is formed by a pair of coplanar first and second rear wall panels 14 and 16 which are foldably joined at their outboard edges to first and second front side walls 10 and 12 along fold lines 15 and 17 respectively, and which have their inboard side edges disposed in juxtaposition with each other.

Figure 3:
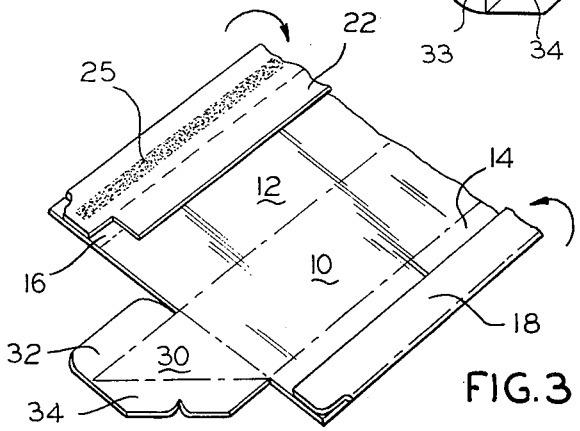
FIGS. 3 and 4 are perspective views illustrating the manner in which the carton blank is folded prior to gluing.

The carton includes an inner partition which extends substantially the full length of the carton and which is formed by a pair of first and second partition panels 18 and 20 which are foldably joined at corresponding side edges to the inboard edges of first and second rear wall panels 14 and 16 along fold lines 19 and 21 respectively. Partition panels 18 and 20 are adhesively secured to each other in face-to-face relation by means of the adhesive indicated at 25 in FIG. 3. The partition extends inwardly from the rear wall to medial portion of said first front side wall and forms a right angle with said first front side wall so as to divide the interior of the carton into two compartments of unequal size. The smaller compartment is triangular in shape and the larger compartment is in the shape of a trapezoid. The purpose of this is, of course, to provide different compartments of varying sizes and shapes which are appropriate for the particular articles to be packaged therein. The other side edge of the first partition panel is disposed in abutting engagement of the inner surface of said first front side wall; whereas the other edge of the second partition panel has foldably joined thereto along a fold line 23 a retaining or positioning flap 22 which is folded at right angles to said second partition panel and which is disposed to lie against the inner face of said first front side wall between said first partition panel and said second front side wall with the free edge of said retaining flap positioned against the interior corner of the carton formed by the juncture of said first and second front and side walls. The purpose of the retaining flap is to maintain the partition in proper position at all times.

The ends of the carton may be closed in various ways. One preferred way of closing at least one end of the carton is the provision of a triangular closure flap 30 hingedly attached along fold line 31 to one end edge of first front side wall 10 as illustrated in FIG. 2. End closure flap 30 includes a pair of front side and rear tuck tabs 32 and 34 which are foldably joined to the other front side edge and the rear edge of closure flap 30 along fold lines 33 and 35 respectively. The tuck tabs are disposed to be inserted into the carton against the other front side wall and the rear wall. It will be seen that rear tuck tab 34 may be provided with a medial recess or slit 37 adapted to receive adjacent portions of the partition panels. Thus, the closure flap also serves to maintain the partition in proper position when the carton is in erected condition.

The opposite end of the carton may also be closed by a similar flap arrangement, or, if desired, may be closed by a film overwrap (not shown).

By virtue of the novel partition arrangement, it is possible to have a glued triangular carton which is collapsible for ease of shipment of cartons to the packager.

Figure 4:
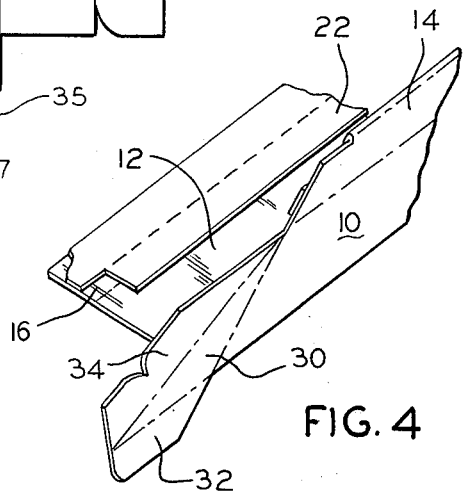

FIGS. 3 through 6 illustrate the manner in which the carton is formed and erected. It will be seen that panels 18 and 20 are folded inward 180° about lines 19 and 21 respectively, and adhesive is applied to panel 20 as shown at 25 in FIG. 3. Next, the first side wall panel 10 and its associated panels are folded 180° about fold line 13 to bring the partition panels in face-to-face contact as shown in FIG. 4 for attachment to each other. The carton would normally be shipped from the manufacturer after being glued and in the collapsed condition as indicated by FIG. 4.

Figure 5:
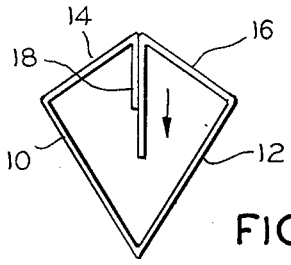
FIGS. 5, 6 & 7 are fragmentary top plan views similar to that of FIG. 1, but illustrating the folding sequence in forming the erected carton.
Figure 7:
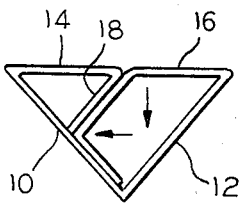
Figure 6:
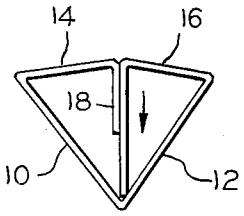

When the carton is to be erected and filled, the rear wall toward the front side walls through the positions indicated in FIGS. 5 and 6 until the partition and retaining flap are in their final positions as indicated in FIG. 7.

Thus it will be appreciated that the invention provides a carton of relatively simple design and construction which affords a collapsible, tubular, triangular compartmented arrangement with two separate compartments of different sizes and shapes which are appropriate to the articles to be packaged.

We claim:

1. In a collapsible, triangular, tubular, compartmented carton formed of foldable paperboard, the combination of:

a. a pair of first and second front side walls foldably joined to each other along corresponding side edges;

b. a rear wall including a pair of coplanar rear wall panels, foldably joined at their outboard side edges to other corresponding side edges of said side walls, and having their inboard side edges in juxtaposition with each other;

c. a pair of co-extensive partition panels having corresponding side edges foldably joined to respective inboard side edges of said rear wall panels and being secured to each other in face-to-face relationship to form a common partition;

d. said partition extending into said carton to a medial portion of one of said front side walls to divide the interior of said carton into two compartments of unequal shape and size;

e. the smaller of said compartments being triangular in shape and the larger of said compartments being trapezoidal in shape;

f. a retaining flap foldably joined at one side edge to another side edge of one of said partition panels and being disposed to lie against the inner surface of said one front side wall with its other side edge positioned in the interior corner of the carton which is formed by the juncture of said front side walls.

2. A carton according to claim 1, and including flap means for closing at least one end of said carton, said flap means including a closure flap foldably joined along one front side edge to an end edge of one of said front side walls and having foldably joined to its other front side edge and its rear edge a pair of front and rear tuck flaps arranged for insertion into the carton behind said other front wall and said rear wall, respectively; said rear tuck flap presenting a medial slit for receiving a portion of said partition to maintain said partition in proper position.

* * * * *